US006631811B2

(12) United States Patent
Komar et al.

(10) Patent No.: US 6,631,811 B2
(45) Date of Patent: Oct. 14, 2003

(54) DISPLAY DEVICE FOR INFLATED BUOYANT NOVELTY BALLOONS

(75) Inventors: Samuel B. Komar, Crystal Lake, IL (US); Steven B. Frank, Elgin, IL (US)

(73) Assignee: CTI Industries Corporation, Barrington, IL (US)

( * ) Notice: Subject to any disclaimer, the term of this patent is extended or adjusted under 35 U.S.C. 154(b) by 0 days.

(21) Appl. No.: 09/945,389

(22) Filed: Aug. 31, 2001

(65) Prior Publication Data

US 2003/0045202 A1 Mar. 6, 2003

(51) Int. Cl.[7] ..... A47F 7/00

(52) U.S. Cl. ..... 211/13.1; 211/94.01; 446/220

(58) Field of Search ..... 211/13.1, 89.01, 211/94.01, 162, 45; 248/205.3, 206.5; 446/220

(56) References Cited

U.S. PATENT DOCUMENTS

| | | | | |
|---|---|---|---|---|
| 260,102 A | | 6/1882 | Langenbach | 12/115.6 |
| 642,780 A | | 2/1900 | Bernard | 211/85.12 |
| 1,580,847 A | | 4/1926 | Moineau | 248/302 |
| 1,623,919 A | | 4/1927 | Hagen | 248/317 |
| 1,689,070 A | | 10/1928 | Elliott | 40/666 |
| 1,997,048 A | * | 4/1935 | Demmy | |
| 2,723,036 A | | 11/1955 | Temple | 211/59.2 |
| 3,186,673 A | | 6/1965 | Olson | 248/309.4 |
| 3,350,045 A | * | 10/1967 | Mayers | |
| 3,726,415 A | | 4/1973 | Malik | |
| 5,024,011 A | | 6/1991 | Collins | |
| 5,035,391 A | | 7/1991 | Steele et al. | |
| 5,036,985 A | | 8/1991 | Lovik | 211/13.1 |
| 5,074,510 A | | 12/1991 | Metz | |
| 5,178,354 A | * | 1/1993 | Engvall | 248/205.3 X |
| 5,188,314 A | | 2/1993 | Peters | |
| 5,275,367 A | * | 1/1994 | Frye | 248/205.3 |
| 5,331,757 A | * | 7/1994 | Ernst et al. | |
| 5,533,285 A | | 7/1996 | Skistimas et al. | |
| 5,568,875 A | | 10/1996 | Johnson et al. | |
| 5,573,437 A | | 11/1996 | Van Dyke et al. | |
| 5,755,419 A | | 5/1998 | Gearhart et al. | |
| 5,820,095 A | * | 10/1998 | Stone | 248/205.3 X |
| 5,823,365 A | | 10/1998 | Page | |
| D400,372 S | | 11/1998 | Poderis | D6/458 |

(List continued on next page.)

FOREIGN PATENT DOCUMENTS

| | | |
|---|---|---|
| WO | WO 98/01844 | 1/1998 |

OTHER PUBLICATIONS

Applicants' application Ser. No. 09/478,639, entitled "Display Rack for Inflated Buoyant Novelty Balloons", filed Jan. 6, 2000.

*Primary Examiner*—Robert W. Gibson, Jr.
(74) *Attorney, Agent, or Firm*—Marshall, Gerstein & Borun LLP

(57) ABSTRACT

A display device for displaying lighter-than-air novelty balloons includes an elongated base with a rear wall and a front wall extending therefrom to form a channel for receiving and retaining balloon weights. The display device is formed from a plastic material and at least one of front or rear walls are flexible with respect to the other. A gap between the upper edge portion of the front wall and the upper edge portion of the rear wall, which has a smaller width that the base of the channel receives and retains balloon weights in a resilient manner. The outer side of the base is adapted to being attached to a display object by an adhesive, a magnetic member, or fasteners. A display rack for displaying lighter-than-air novelty balloons includes a pole for attaching a plurality of the display devices thereto in a vertical orientation. A support base provides support for the pole and maintains the pole in an upright position. Another display rack for displaying lighter-than-air novelty balloons includes a flat surface for attaching a plurality of the display devices to its edges. The flat surface provides a space for displaying signs.

60 Claims, 9 Drawing Sheets

U.S. PATENT DOCUMENTS

D401,255 S * 11/1998 Burns
5,865,325 A 2/1999 Comstock
5,901,859 A * 5/1999 Carr et al. ..... 211/45
6,109,462 A 8/2000 Emalfarb et al. ..... 211/119
6,209,730 B1 * 4/2001 Ewing ..... 211/94.01 X
6,238,259 B1 5/2001 Medina
6,273,374 B1 * 8/2001 Mc Duffey ..... 248/205.3
6,422,914 B1 * 7/2002 Nelson et al. ..... 446/220

* cited by examiner

DISPLAY DEVICE FOR INFLATED BUOYANT NOVELTY BALLOONS

FIELD OF INVENTION

This invention relates generally to articles for displaying retail merchandise and, more specifically, to display racks for prominently retaining and presenting helium-filled novelty balloons generally at eye level in neat, untangled, and orderly fashion in retail settings.

BACKGROUND OF THE INVENTION

The increasing popularity of lighter-than-air balloons, such as helium-filled novelty balloons, presents a unique problem for retailers. By their nature, these buoyant balloons are difficult to display when inflated in a manner that makes it easy for the consumer to see the graphics on the face of the balloons. One widely-used device for displaying helium balloons consists of a so-called "Balloon Corral®," such as a confined area delimited by fish line, suspended, for example by chains, at or some distance just below the ceiling of a retail establishment. Such a "Balloon Corral®" keeps the balloons from blowing and moving around the store. Once a consumer selects a balloon, the balloon can be removed from the corral for purchase by pulling down on the tether, i.e., the string or ribbon affixed to the balloon's neck near the inflation opening in the bottom of the balloon, until the balloon sinks below the outer frame of the corral and can be removed for purchase.

Such a "Balloon Corral®" has many serious shortcomings. First, because the "Balloon Corral®" is mounted at or near the ceiling, the balloons are typically 10 to 12 feet above the floor, which makes it difficult for consumers to see the graphics printed on the faces of the balloons, and to see which tether line belongs to a desired balloon, in order to select one or more desired balloons. Consumers have to strain their necks to look upward toward the ceiling at the balloons in the "Balloon Corral®", and some consumers even have difficulty reaching the balloon tethers. Since the graphics of the balloons are normally printed on the generally flat front and rear faces of the typically mylar-type novelty balloons, the haphazard placement of balloons in the corral may visually hide the graphics. This requires consumers to pull on the balloon tethers to rearrange and re-orient the balloons in order to see the graphics of each of the inflated balloons on display. Also, the balloons with graphics for different seasonal themes and sentiments are typically mixed together. Frequently, balloons are accidentally pulled out of the Balloon Corral® by consumers to allow viewing of the graphics. Then, if the consumer does not desire a particular balloon, he or she may simply release the tether, allowing the balloon to rise to blow around on the ceiling of the retail establishment outside the Balloon Corral®.

This can be particularly problematic, for example in drug stores, discount stores, convenience stores, and grocery stores, in which novelty items such as novelty balloons may be in a corral in a floral or greeting card department because retrieving the novelty balloons may be very difficult. The high ceilings of the growing number of warehouse-style bulk merchandise club stores also make it difficult to retrieve errant balloons, even by their tethers, once the balloons are released from the corrals. Air conditioning systems also have a tendency to blow balloons out of the corrals. Another drawback to the Balloon Corral® is that sensitive motion detectors in many retail store security systems have a tendency to trigger false intruder alarms due to any movement of the balloons within the corrals, needlessly dispatching security personnel or police officers to the retail location. Yet another drawback to the Balloon Corral® is the difficulty of servicing it, such as when balloon tethers become tangled in the fish line, because of the corral's proximity to the ceiling. A high ladder or automatic lift device is often required, which may not be readily available at the retailer's facility.

Another type of rack for displaying balloons is shown in U.S. Design Pat. No. D 400,372. That design patent shows a two-tiered rack, both tiers being generally square, and having a downwardly-open clamp below the lower tier, with a threaded bolt, for mounting the rack. The apparent manner of use of the balloon rack shown in that design patent is to tie each balloon tether to one of the outwardly-projecting, upwardly-bent flanges provided on the lower tier only, with the relatively larger and higher second tier being used to separate the balloon tethers from one another to avoid tangling of the balloon tethers.

While such a balloon rack permits display of buoyant balloons at a generally lower height than that of the "Balloon Corral®," it requires tying the tether of the balloon to the lower tier for securement. Since most balloon tethers are string or ribbon, the tying for securement and untying by the consumer for purchase or viewing often causes undesirable fraying of the tether, or simply permits them, if not properly re-tied to the display rack, to undesirably float up to the store's ceiling.

Recently, balloon weights have become commonplace as the desired devices for securing lighter-than-air balloons against floating to the ceiling of retail establishments, and later, as convenient handles and tether weights for the ultimate consumer. One such balloon weight has a circular profile and is in the shape of a spool, wherein a lowermost end of the tether is secured to or near the center of the spool, such as the type of balloon weight shown in U.S. Pat. No. 5,188,314. Another spool-type balloon weight is available from Premium Balloon Accessories® of Sharon Center, Ohio under the trade name "Premium Ribbon Weight™". That spool-type balloon weight can be used to selectively release desired lengths of the tether of the balloon and provide a useful handle for consumers, including children, to hold the balloon and prevent it from floating away when they exit the retail building.

The Premium Ribbon Weight™ initially includes a flat plastic balloon coupling member integral with a generally spool-shaped plastic disc. A V-shaped weakened groove is provided along the area of attachment between the balloon coupling member and the spool-shaped disc. The balloon coupling member includes a double-sided adhesive strip on one side thereof, and a ribbon-receiving aperture or slit is provided in the center of the coupling member. One end of a length of tether ribbon is secured through the ribbon-receiving aperture, looped about the balloon coupling member, and secured to the balloon coupling member by a first side of the double-sided adhesive strip.

Prior to attachment to the inflation valve neck area of a novelty balloon, the balloon coupling member is broken away from the spool-shaped member by snapping the two components apart along the weakened V-shaped groove. The second side of the double-sided adhesive strip is provided with a removable backing, so that the second side can be exposed when the backing is removed for adhesive attachment of the balloon coupling member to a balloon. The remainder of the length of ribbon is tightly wrapped in the spool-type weight.

For large inflated buoyant novelty balloons, a thicker and heavier spool-type balloon weight is used to counter the extra lift of the larger balloons. Other spool-type balloon weights having circular, or even other shaped profiles, e.g., heart shapes, simply have an extension with an aperture, or eyelet, to receive a lowermost tied end of the tether. It would be desirable for a balloon display rack to accommodate such balloon weights and provide a convenient, easy-to-use location for retailers to mount inflated novelty balloons in a way that facilitates viewing of the graphics on each balloon's faces. The Premium Ribbon Weight™ device also has such an eyelet integral with the spool-shaped disc, which could be used for tying additional balloons to the weight, or to hook the balloon weight onto certain conventional balloon racks.

SUMMARY OF THE INVENTION

A device for displaying lighter-than-air novelty balloons includes an elongated base with a rear wall and a front wall extending therefrom to form a channel for receiving and retaining balloon weights. At least one of front and rear walls are flexible with respect to the other. A gap between the upper edge portion of the front wall and the upper edge portion of the rear wall, which has a smaller width that the base of the channel receives and retains balloon weight in a resilient manner. The outer side of the base is adapted to being attached to a display object by an adhesive, a magnetic member, or fasteners. The channel is formed from a plastic material and attached to a display object.

A tree-stand type display rack for displaying lighter-than-air novelty balloons includes a plurality of display devices, each display device including an elongated base with a rear wall and a front wall extending therefrom to form a channel for receiving and retaining balloon weights. At least one of front and rear walls are flexible with respect to the other. A gap between the upper edge portion of the front wall and the upper edge portion of the rear wall, which has a smaller width that the base of the channel receives and retains balloon weight in a resilient manner. The outer side of the base is adapted to being attached to the display rack by an adhesive, a magnetic member, or fasteners. The channel is formed from a plastic material. The display rack includes a pole for attaching the plurality of display devices thereto in a vertical or angled orientation. A support base provides support for the pole and maintains the pole in an upright position.

A sign-type display rack for displaying lighter-than-air novelty balloons includes a plurality of display devices, each display device including an elongated base with a rear wall and a front wall extending therefrom to form a channel for receiving and retaining balloon weights. At least one of front and rear walls are flexible with respect to the other. A gap between the upper edge portion of the front wall and the upper edge portion of the rear wall, which has a smaller width that the base of the channel receives and retains balloon weight in a resilient manner. The outer side of the base is adapted to being attached to the display rack by an adhesive, a magnetic member, or fasteners. The channel is formed from a plastic material. The display rack includes a flat surface for attaching the plurality of display devices thereto. The flat surface provides a space for displaying a sign.

DETAILED DESCRIPTION OF THE PREFERRED EMBODIMENT

Figure 2:
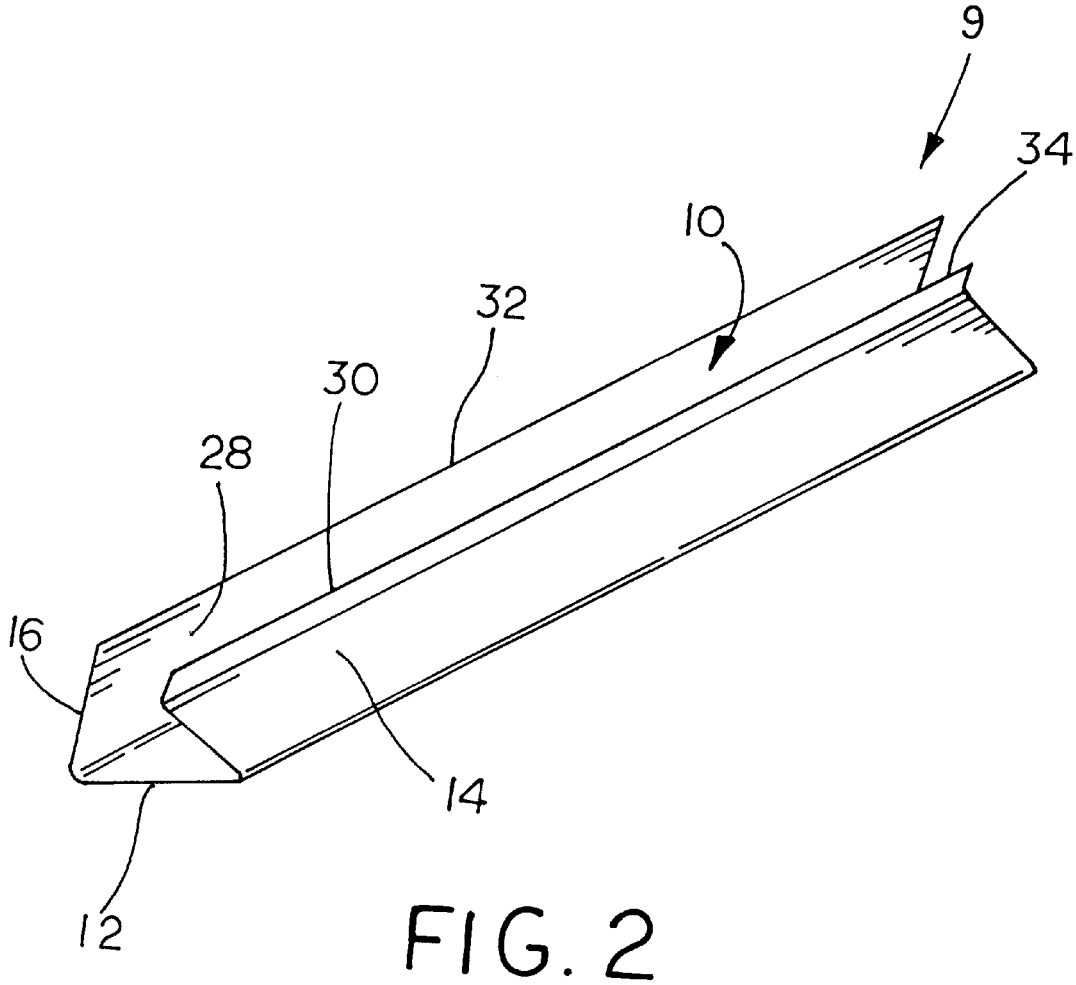
FIG. 2 is an isometric view of the balloon display device of the present invention.
Figure 3:
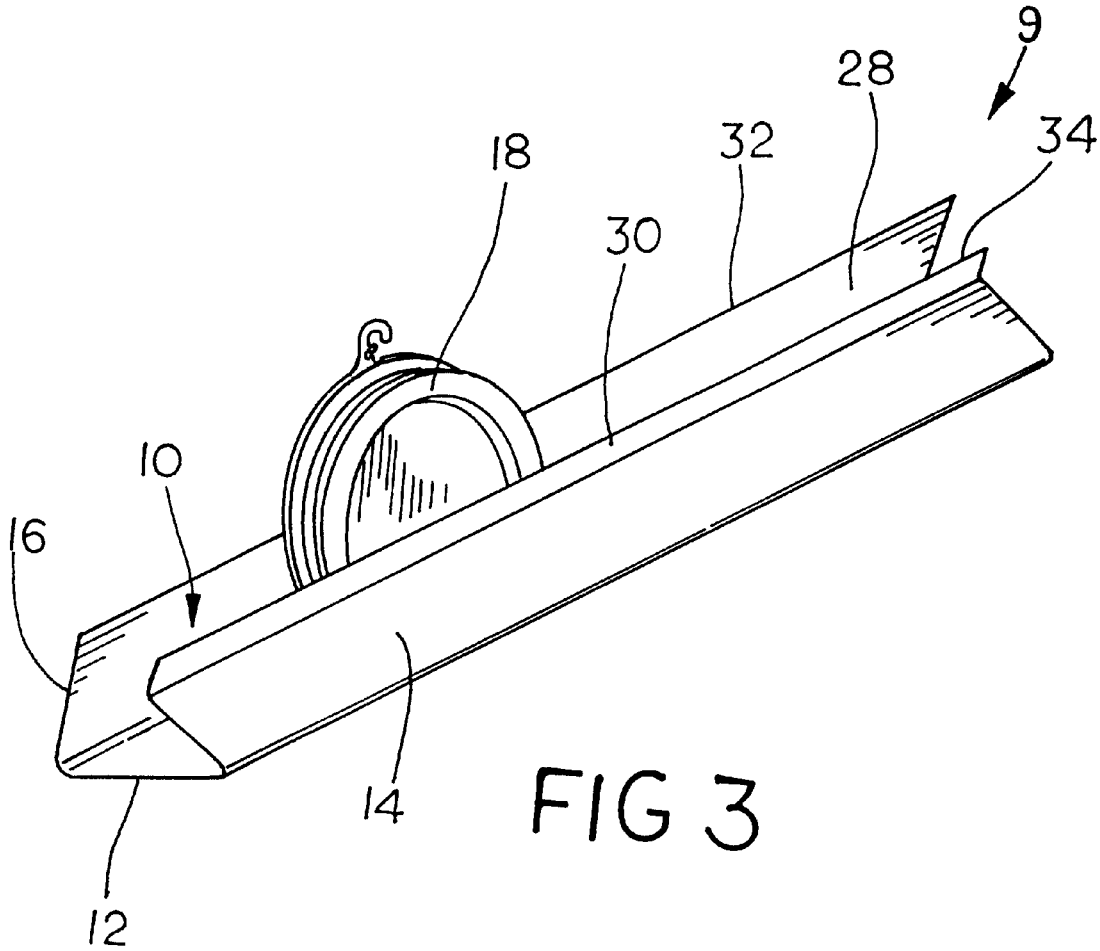
FIG. 3 is an isometric view of the the balloon display device of the present invention having received a spool-type balloon weight.
Figure 4:
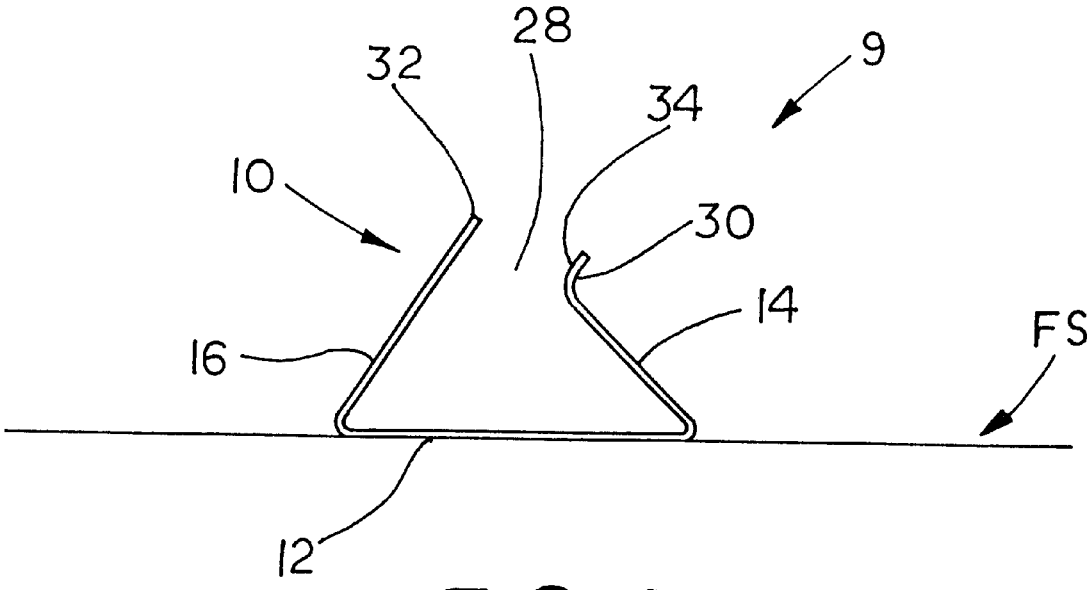
FIG. 4 is a front elevational view of the balloon display device of the present invention.
Figure 5:
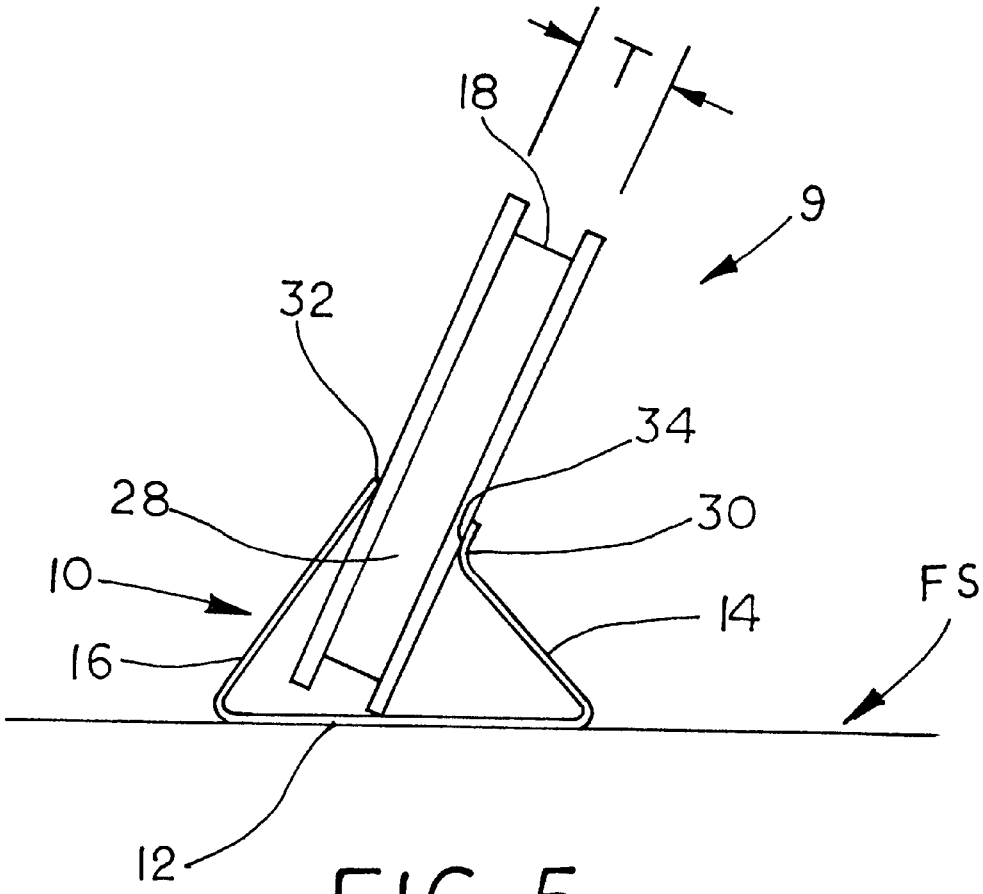
FIG. 5 is a front elevational view of the balloon display device of FIG. 4 having received a spool-type balloon weight.
Figures 6, 7, 10:
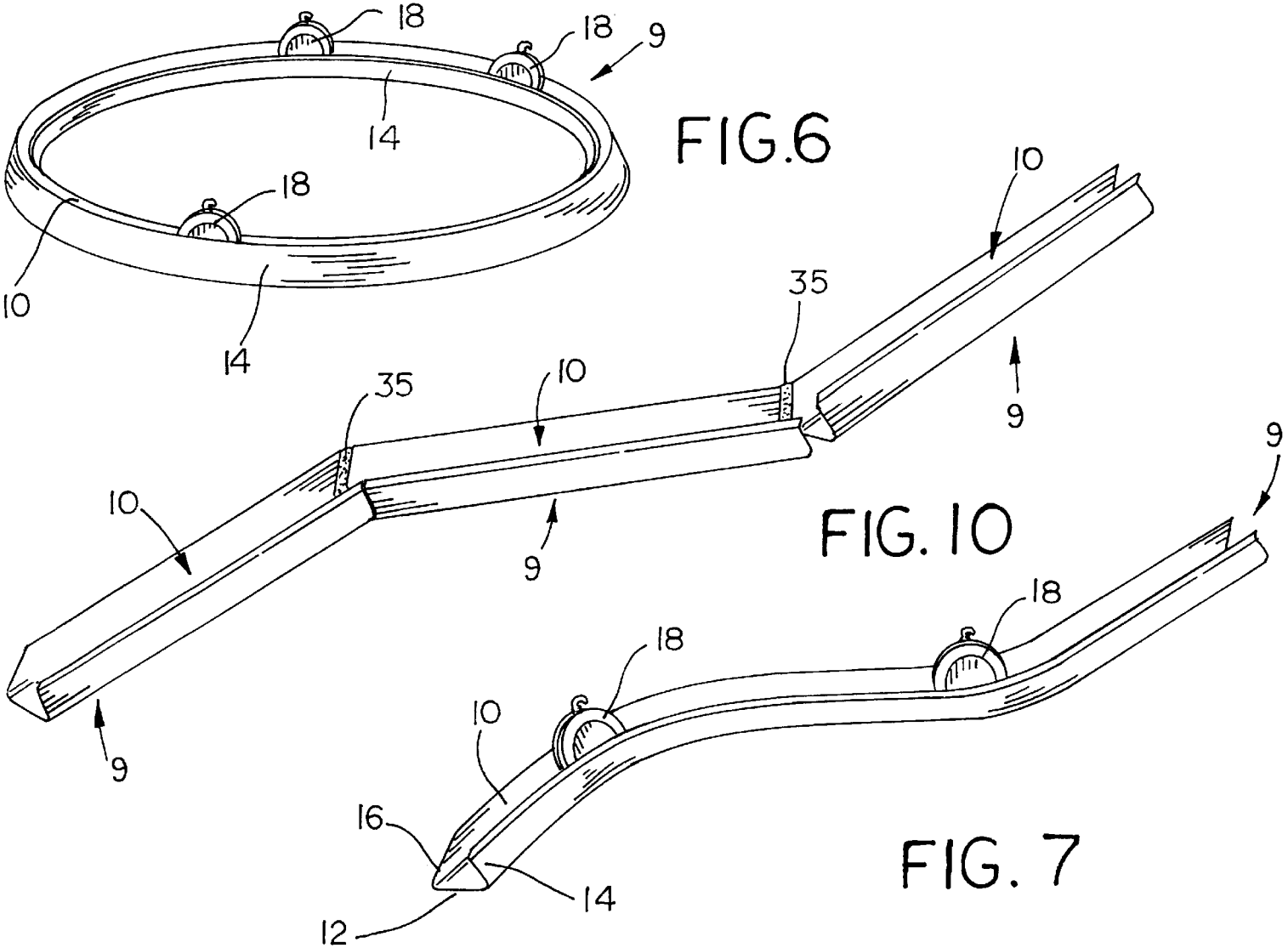
FIG. 6 is an isometric view of the balloon display device of the present invention manufactured in circular form.
FIG. 7 is an isometric view of the balloon display device of the present invention manufactured in curved form.
FIG. 10 is an isometric view of three display devices of the present invention connected with hinges.

Referring to FIGS. 2–10, a balloon display device generally designated by reference numeral 9 includes an elongated channel 10 defined by a base 12, a front flexible wall 14 and a rear flexible wall 16. The channel 10 is adapted for receiving and releasably gripping at least one or several balloon weights 18 (shown in FIGS. 3, 5–7 and 9). It will be appreciated by those of ordinary skill in the art that the balloon weight 18 may take on various forms, including cards, paper or cardboard hangers, toys, games, or any other item that has adequate weight to hold a balloon on the display rack. In this disclosure and the drawings, a spool-type balloon weight is described in detail, but the display device is not limited to use only with spool-type balloon weights, such that the channel 10 can be sized to accommodate, i.e., releasably receive and grip, the specific type of balloon weight in question. As shown in FIG. 2, the channel 10 can be manufactured in linear sections of desirable length. Also, as shown in FIGS. 6 and 7, the channel 10 can be manufactured in closed circular form or a curved form, respectively.

Figure 1:
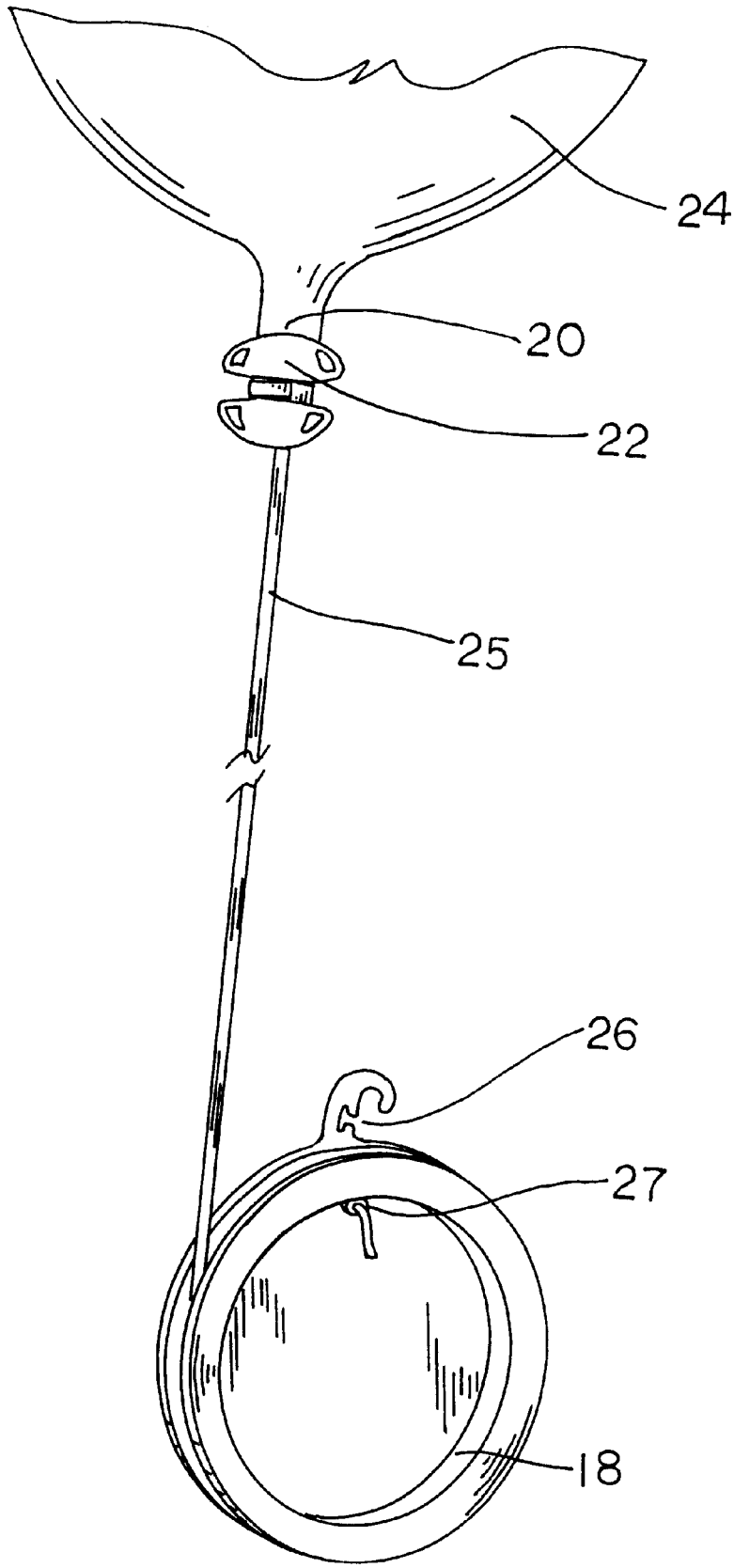
FIG. 1 is a perspective view of a balloon, broken-away, tethered to a short length of ribbon unwound from a spool-type balloon weight.

Referring to FIG. 1, in a spool-type of balloon weight 18, e.g., the "Premium Ribbon Weight®" available from Premium Balloon Accessories®, a flat balloon interface member 20 is adhesively secured to the balloon neck valve or opening 22 of an inflated buoyant balloon 24 using double-stick adhesive (not shown). An upper end of a balloon tether 25, such as a string or ribbon, is looped around the mid-section of the balloon interface member 20, and secured thereto with the double-stick adhesive (not shown).

A lower end of the balloon tether 25 is wrapped around the spool of the circular balloon weight 18, and extends through an aperture 26 in the spool. A knot 27 in the balloon tether 25 that is larger than the aperture 26 prevents the balloon tether 25 from floating away from the balloon weight 18.

Referring again to FIGS. 2–10, the front flexible wall 14 and the rear flexible wall 16 of balloon display device 9 extend from the base 12 to form the channel 10. In the preferred embodiment, the front flexible wall 14 and the rear flexible wall 16 extend from the base 12 toward each other to define a gap 28 that is smaller in width than the width of the base 12. Thus, each of the flexible walls 14 and 16 forms an acute angle with the base 12.

Figure 8:
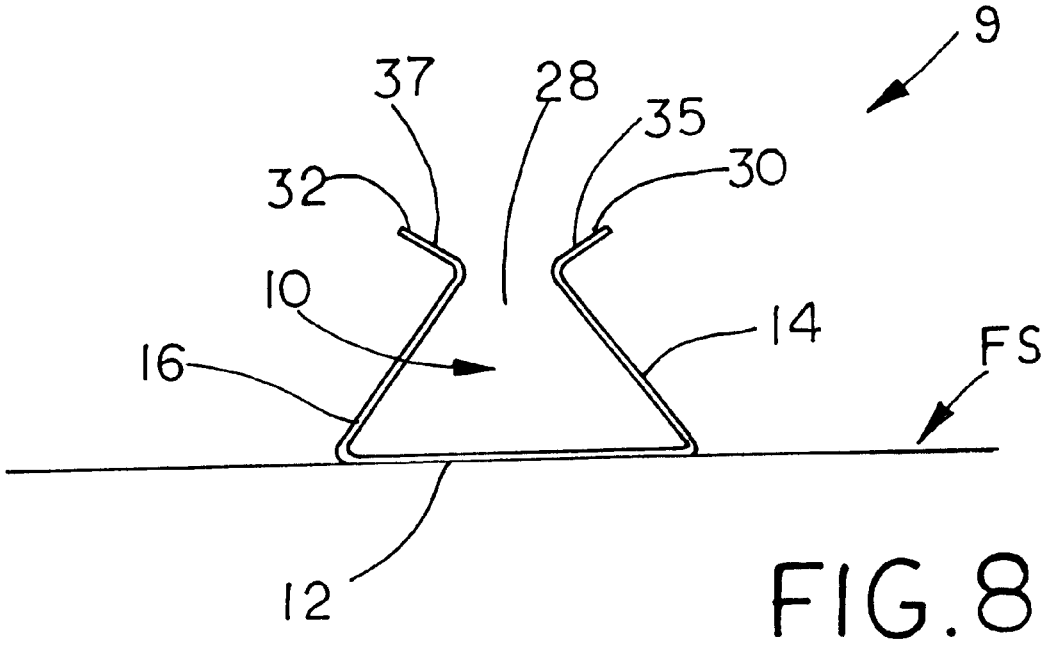
FIG. 8 is a front elevational view of an embodiment of the balloon display device of the present invention.
Figure 9:
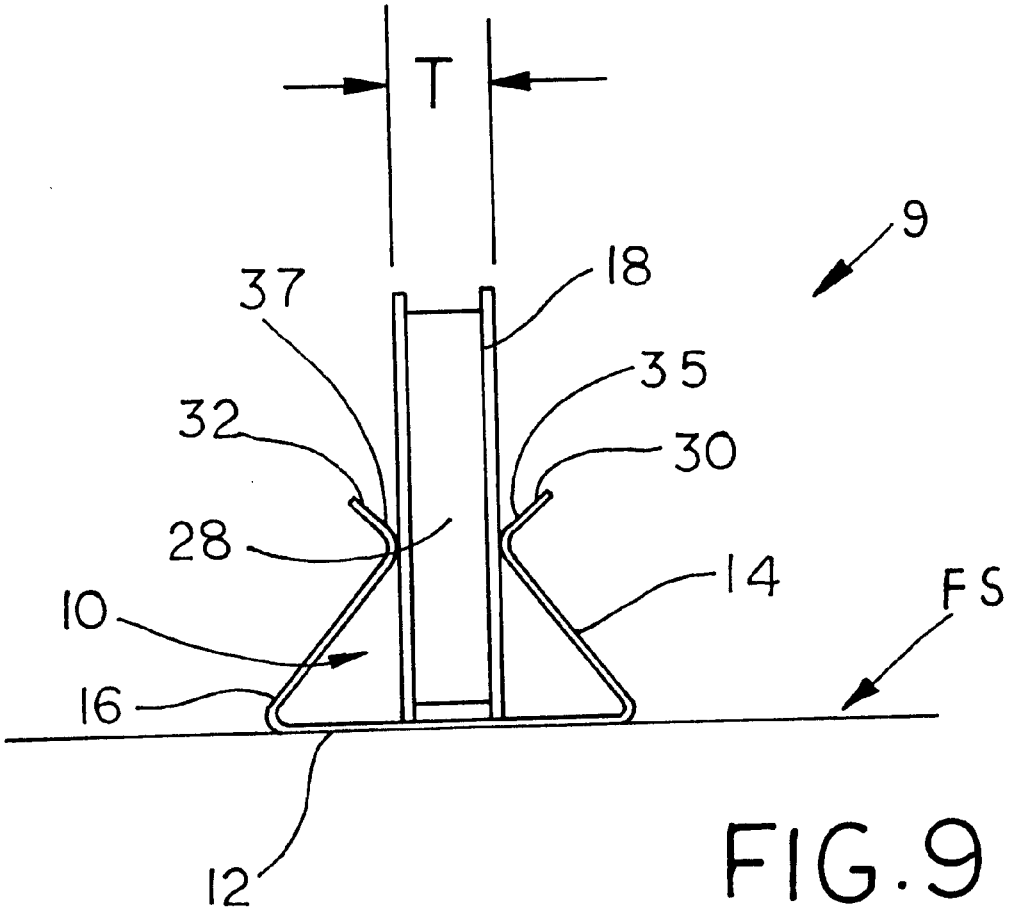
FIG. 9 is the balloon display device of FIG. 8 having received a spool-type balloon weight.

As shown in FIGS. 2–5, the upper edge portion 30 of the front flexible wall 14 can be disposed lower than the upper edge portion 32 of the rear flexible wall 16, so that the plane defining the gap 28 is sloped downwardly from the rear to the front. While this sloped orientation of the channel 10 facilitates ready insertion and removal of balloon weights 18, such as when the balloon display device 9 is mounted horizontally with the channel 10 facing forward, e.g., on the top edge of a metal greeting card rack, it is recognized that the top of the channel 10 may instead have a generally flat orientation. To further facilitate insertion and removal of balloon weights 18, the upper edge portion 30 of the front flexible wall 14 is bent away from the rear flexible wall 16, creating a guide surface 34. The guide surface 34 facilitates the guiding of balloon weights 18 in and out of the channel 10 when balloon weights 18 are being inserted and removed from the balloon display device 9, respectively. Also, as shown in FIGS. 8 and 9, the upper edge portion 30 of the front flexible wall 14 can be disposed at the same level as the upper edge portion 32 of the rear flexible wall 16, so that the plane defining the gap 28 is not sloped with respect to the base 12. To further facilitate insertion and removal of balloon weights 18, the upper edge portion 30 of the front flexible wall 14 and the upper edge portion 32 of the rear flexible wall 16 are bent outwardly to create two guide surfaces 35 and 37, which facilitate the guiding of balloon weights 18 in and out of the channel 10 when balloon weights 18 are being inserted and removed from the balloon display device 9, respectively.

The size of the gap 28 is slightly smaller than the thickness T (see FIGS. 5 and 11) of the balloon weight 18. Inserting a balloon weight 18 in the channel 10 will slightly expand the size of the gap 28, i.e., by slightly outwardly flexing the flexible walls 14, 16. As a result, the upper edge portion 30 of the front flexible wall 14 and the upper edge portion 32 of the rear flexible wall 16 resiliently hold and releasably grip the balloon weight in the channel 10. The balloon weight 18 can be removed from the channel 10 of balloon display device 9 by a light pulling thereof from the channel 10 against the light resilient holding force of the front flexible wall 14 and the rear flexible wall 16. Because of the flexibility of the front flexible wall 14 and the rear flexible wall 16, a heavier spool-type balloon weight with a thickness larger than T can be inserted and releasably gripped by the channel 10. The heavier and thicker spool type balloon weight is used for larger inflated buoyant novelty balloons to counter the large lift of such balloons.

In the preferred embodiment, the outer surface of the base 12 includes an adhesive backing for attachment of the channel 10 to a display object. To attach the channel 10 to a display object, a protective cover on the adhesive backing is peeled off and the channel 10 is attached to a surface on the display object. The attachment of the channel 10 to a display object is not limited to using an adhesive. The channel 10 may be fastened to a display object by other means of attachment such as screws, brackets, hooks and magnets. In another preferred embodiment, the channel 10 may be attached to a display object by a magnetic strip that is attached to the base 12. The means for attaching the channel 10 to a display object depend on the type and shape of the display object. For example, a display object that has flat surfaces may be a good candidate for receiving the channel 10 having an adhesive backing. In such a case, the surface of the adhesive backing attaches securely to a surface of corresponding size on the display object. Non-adhesive means of attachment may be suitable for display objects that cannot provide a surface corresponding in size to the outer surface of the base 12. For example, attachment of the channel 10 to a bar may be accomplished by providing an aperture on the base 12 of the channel 10 and a corresponding aperture on the bar, wherein the apertures are then aligned for receiving a screw or a nut/bolt combination to attach the channel 10 to the bar. Additionally, attachment of the channel 10 to a bar or a cylindrical object may be accomplished by means of spring clamps, which can be attached to the channels 10 with nut/bolt combination. The spring clamps provide for detachable attachment of the channels 10 to a cylindrical display object. It will be appreciated by those skilled in the art that because the outer surface of the base 12 provides a continuous and narrow flat surface along the entire channel 10, display objects in a variety of shapes or forms can be used for attachment of the channel 10 with a suitable means of attachment.

It will be further appreciated by those skilled in the art that the balloon display device 9 can be attached to a display object in any orientation desired. The display device 9 can be attached in a horizontal orientation to a display object that has a horizontally-aligned surface (see flat surface FS is FIGS. 4, 5, 8 and 9) to support the display device 9, whether that surface itself is horizontal or vertical. For instance, the display device 9 can be mounted in a horizontal orientation such that the gap 28 opens upward, or it can be mounted in a horizontal orientation such that the gap 28 opens sideways. In other words, attaching the display device 9 in a horizontal orientation means that the display device 9 is substantially parallel with the ground, regardless of the direction which the gap 28 opens. A horizontally-aligned surface can be found on display objects such as a counter, a wall surface, a greeting card display rack, different types of shelving systems, magazine racks, etc. The display device 9 can be attached in a vertical orientation to a display object having a vertically-aligned surface for attachment of the display device 9. Such a display object could be a vertical pole having a round or rectangular cross section, e.g. the vertical pole of the tree-stand type novelty balloon display rack, or the vertical surfaces on different types of display racks, shelving systems, magazines racks, and walls. The display device 9 can also be attached to any of the above-noted objects in orientations other than horizontal or vertical so long as a surface on the display object can accommodate the channel 10 of the display device 9. As shown in FIG. 10, several channels 10 of equal and/or different lengths can be connected together with hinges 35 for providing a ready-customizing of the display devices 9 for attachment to multiple surfaces on a display object. For instance, the channels 10 being connected with hinges 35 can be attached to a horizontal surface, and can be easily removed and attached to a corner of another display object having a horizontal and vertical surface. The connection of the channels 10 with hinges 35 further provides for forming various geometric shapes with the display devices 9 (i.e., square, zig-zag line, triangle, etc.).

Figure 11:
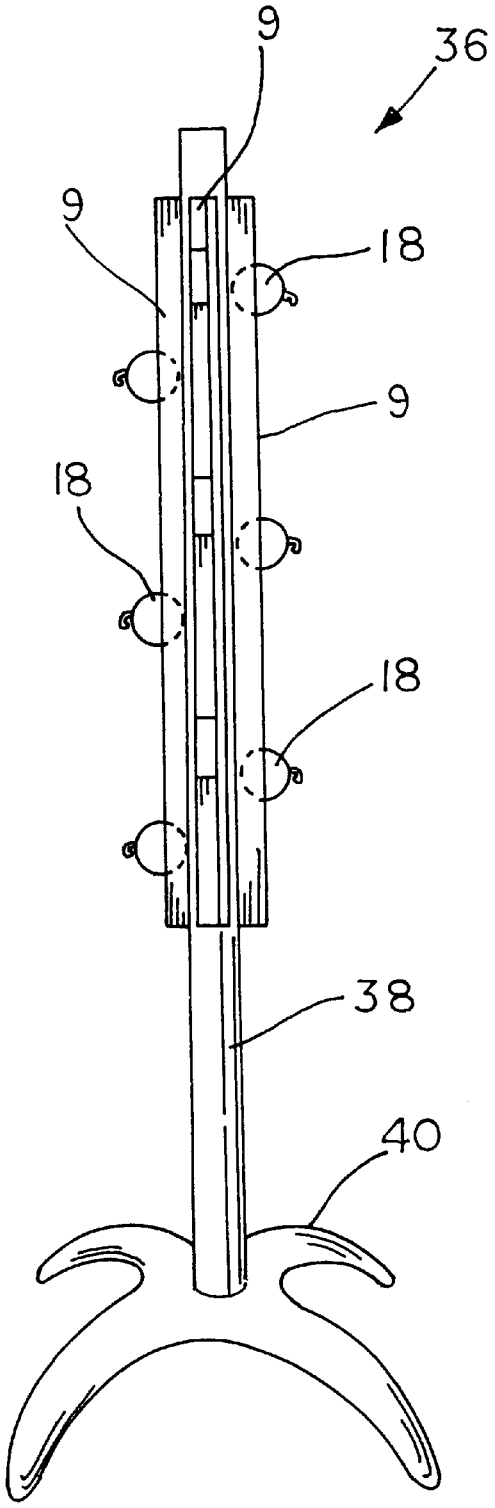
FIG. 11 is a front elevational view of the balloon display device of the present invention as an alternate embodiment when mounted to a tree-stand type display rack.
Figure 12:
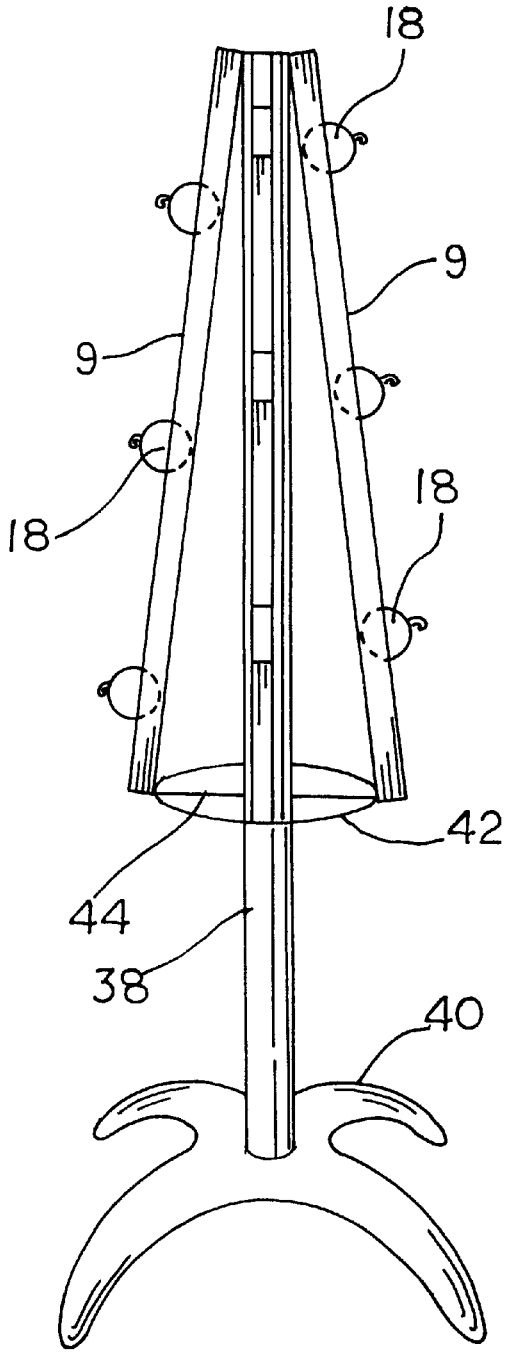
FIG. 12 is a front elevational view of the balloon display device of FIG. 11 with an added expansion ring.
Figure 13:
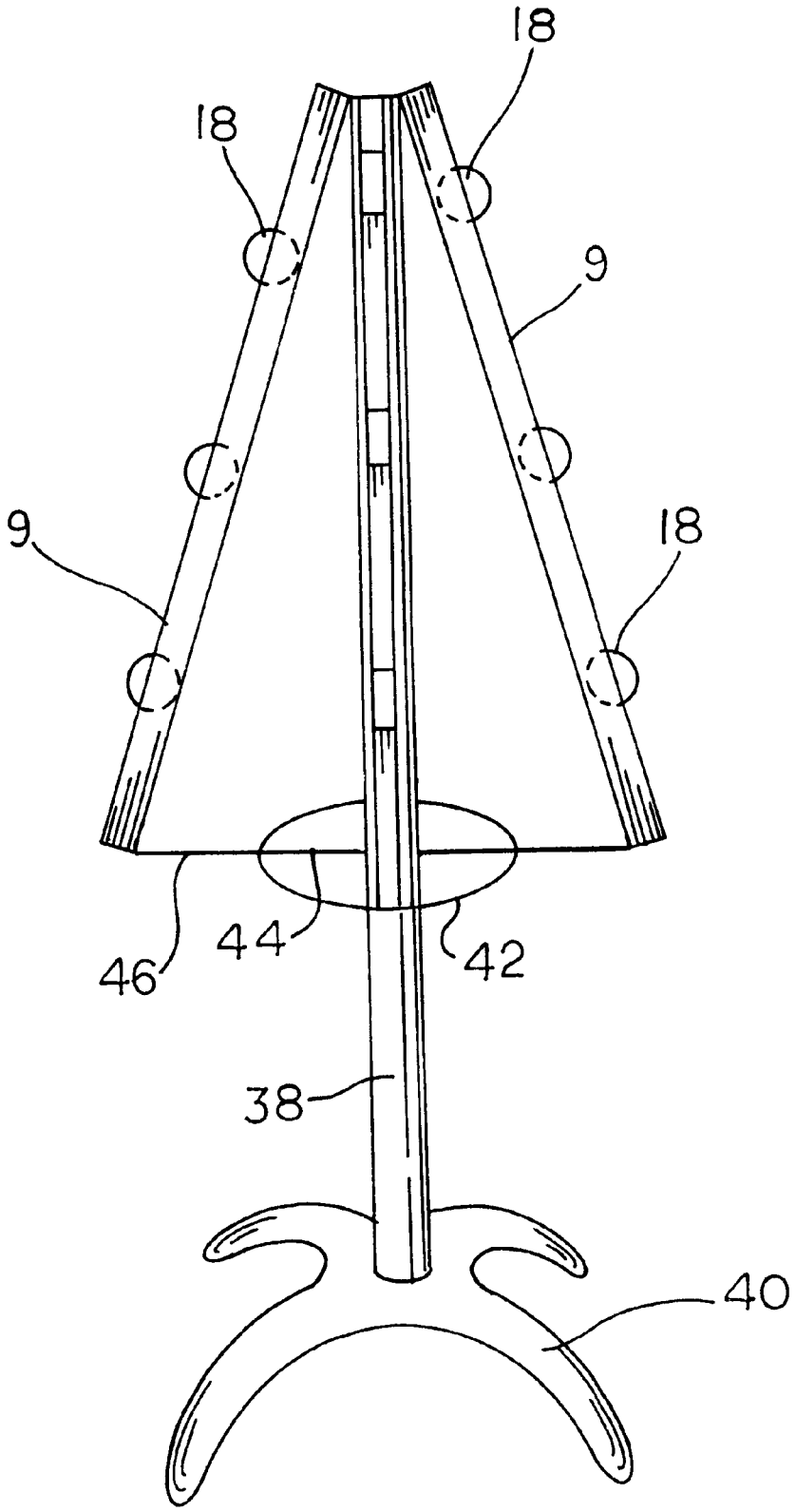
FIG. 13 is a front elevational view of the balloon display device of FIG. 12 with added extension bars.

FIGS. 11–13 depict a tree-stand type novelty balloon display rack 36 which includes a pole 38, a support base 40 and a plurality of display devices 9 disposed radially on the pole 38 and attached to the pole 38 in a vertical orientation (FIG. 11), or in an angled orientation (FIGS. 12 and 13). As shown in FIG. 11, attachment of the display devices 9 to the pole 38 in a vertical orientation can be accomplished by attaching the display device 9 directly to the outer surface of the pole 38 utilizing any of the above-disclosed methods of attaching the display device 9 to a display object. As shown in FIG. 12, attaching the display devices 9 to the pole 38 in an angled orientation can be accomplished by attaching one end of the display device 9 to a large ring 42 disposed at a lower portion of the pole 38 and the other end of the display devices 9 to a top portion of the pole 38. The ring 42 is attached to the lower portion of the pole 38 with spokes 44. Additionally, as shown in FIG. 13, extension rods 46, which can be attached to the ring 42 at one end, and to the display devices 9 at the other end, can further extend the distance of the lower end of the display devices 9 from the pole 38. The display devices 9 can be attached to the pole 38 in both the vertical orientation and angled orientation due to non-interference of these two modes of attachment. When utilizing both attachment methods, a number of display devices 9 can be attached directly to the outer surface of the pole 38, and a number of other display devices 9 can be attached to the ring 42 disposed at the lower portion of the pole 38. Preferably, the length of each display device 9 should allow access to the balloon weights 18 by most customers. When the display devices 9 are attached to the pole 38 in a vertical orientation, the number of display devices 9 that the pole 38 can accommodate depend on the circumference of the pole 38. In other words, the larger the diameter of the pole 38, the more display devices 9 can be attached thereto. When the display devices 9 are connected to the pole 38 in an angled orientation, the number of display devices 9 that the pole 38 can accommodate depend on the circumference of the ring 42 and the added circumference due to addition of extension rods 46.

The display rack 36 provides an aesthetically pleasing display for novelty balloons, prevents the tethers of the novelty balloons from becoming entangled and allows each of the novelty balloons to be fully displayed. When the display rack 36 is filled with novelty balloons, it provides a colorful and pleasing tree-shaped form that will attract customers. The display rack 36 is light weight and can be moved and placed anywhere in a store where novelty items are typically sold. When the display rack 36 is filled, the inflated novelty balloons collectively form a tree shape. Preferably, the tether length of every inflated novelty balloon on a display devices 9 is substantially the same so that each inflated balloon will be in contact with a higher novelty balloon, a lower novelty balloon and adjacent novelty balloons. Thus, the tethers of the balloons will be separated and prevented from becoming entangled. Furthermore, because of the difference in height and distance of each novelty balloon relative to another novelty balloon in the display rack 36, all novelty balloons in the display rack 36 will be substantially visible to a customer. As a result, a customer can visually select a novelty balloon without removing any novelty balloons from the display rack 36 and only remove the selected novelty balloon from the display rack 36.

Figure 14:
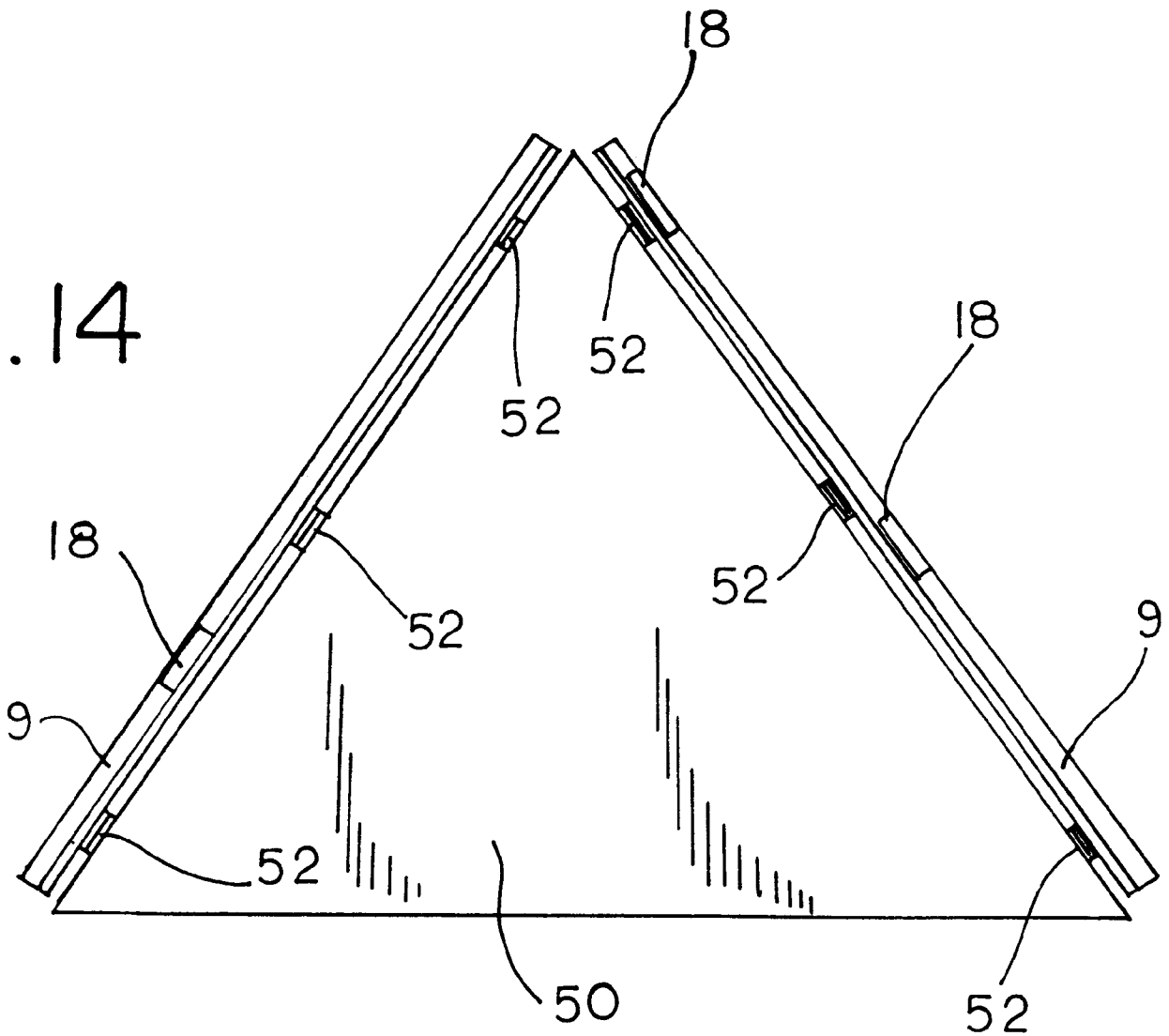
FIG. 14 is a top elevational view of the balloon display device of the present invention as an alternate embodiment when mounted to a sign-type display rack.

FIG. 14 depict a sign-type novelty balloon display rack 48 that includes a flat surface 50 and a number of display devices 9 attached to the circumference of the flat surface 50. The sign-type display rack 50 can be attached to the end portion of a check-out counter of a food store, novelty shop, or a counter at any type of store where the customer stands near the counter to receive any type of service or pay for a service. The flat surface 50 can be of any geometrical shape, such as square, rectangle, circle, triangle (shown in FIG. 16), etc. The top of the flat surface 50, which a customer sees, can be used as a sign for advertisements, displaying the price of the novelty balloons, graphically displaying other types of novelty balloons not physically displayed, or any other information which is intended for a customer to see. Additionally, the design of the sign on the flat surface 50 can provide an eye-catching visual effect so as to entice a customer to purchase one or more inflated novelty balloons.

Display devices 9 can be attached to the circumference of the flat surface 50 to accommodate balloon weights 18. For example, as shown in FIG. 16, channels 10 of lengths substantially equal to the lengths of the sides of a triangular flat surface 50 can be attached to the circumference of the triangular flat surface 50. The geometric shape of the flat surface 50 or its size can be customized for attachment to different store counters. The channels 10 can be attached to the flat surface 50 by any of the above-disclosed methods for attaching the channel 10 to any display object, such as adhesive tape, magnetic members, or clamps (i.e., c-clamps). The flat surface 50, as shown in FIG. 14, for example, can be supplied with adhesive tabs 52 on its circumference for attachment of the channels 10. Additionally, channels 10 connected with hinges 35 (shown in FIG. 10) can be used to form a geometric shape corresponding to the flat surface 50 for quick attachment.

It will be appreciated by those skilled in the art that the balloon display device 9 can be constructed from a variety of materials such as metal, plastic, cardboard, or wood. In the preferred embodiment, the channel is made from a one piece clear plastic material that is formed in the shape of the channel 10. The clear plastic display device 9 is light weight, blends-in with the background color and texture of the display object which is attached to, and the balloon weights 18 are fully visible when inserted therein. Furthermore, the clear plastic channel 10 can be mass manufactured in a variety of lengths, shapes, and/or sizes to accommodate any number of balloon weights 18 or have the capability to attach to any type and orientation of display object. Additionally, the clear plastic channel 10 can be custom cut to different custom sizes, such as with a cutting blade just prior to being attached to a display object. Thus, the channel 10 can be manufactured in one size and custom cut on site by a person attaching the channel 10 to various display objects.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights of all modifications which come within the scope of the appended claims are reserved.

What is claimed is:

1. A device for displaying lighter-than-air novelty balloons comprising in combination:

an elongated base having an outer side adapted for attachment to a display object;

a rear wall extending from said base in a direction away from the display object;

a front wall extending from said base in a direction away from the display object;

at least one of front and rear walls being flexible relative to the other; and wherein, said base, said rear wall and said front wall define a channel sized for resiliently receiving and retaining at least one weight for securing a balloon to a tether, said channel including means for flexibly connecting said channel to another channel.

2. The device of claim 1, wherein said channel comprises an outer opening defined by a gap between an upper edge portion of said rear wall and an upper edge portion of said second wall, the outer opening having a smaller width than the width of said base.

3. The device of claim 1, wherein said second wall further comprises an outwardly extending tip portion.

4. The device of claim 1, wherein said first wall and said second wall each comprise an outwardly extending tip portion.

5. The device of claim 1, wherein the outer side of said base is attached to the display object by an adhesive.

6. The device of claim 1, wherein the outer side of said base is attached to the display object by a magnetic member.

7. The device of claim 1, wherein the outer side of said base is attached to the display object by a fastener.

8. The device of claim 1, wherein said rear wall is curved.

9. The device of claim 1, wherein said front wall is curved.

10. The device of claim 1, wherein said channel is formed from a plastic material.

11. The device of claim 1, said means for flexibly connecting comprising a hinge.

12. The device of claim 2, wherein said outer opening has a smaller width than the thickness of a weight for securing a balloon to a tether.

13. The device of claim 2, and a balloon weight releasably retained within said outer opening.

14. A device for displaying lighter-than-air novelty balloons comprising in combination:

an elongated base having an outer side adapted for attachment to a display object;

a rear wall extending from said base in a direction away from the display object;

a front wall extending from said base in a direction away from the display object;

at least one of front and rear walls being flexible relative to the other; and at least one balloon weight for securing a balloon to a tether;

wherein, said base, said rear wall and said front wall define a channel sized for resiliently receiving and retaining the at least one weight, said channel having an outer opening defined by a gap between an upper edge portion of said rear wall and an upper edge portion of said front wall, the outer opening having a smaller width than the width of said base.

15. The device of claim 14, wherein said second wall further comprises an outwardly extending tip portion.

16. The device of claim 14, wherein said first wall and said second wall each comprise an outwardly extending tip portion.

17. The device of claim 14, wherein the outer side of said base is attached to the display object by an adhesive.

18. The device of claim 14, wherein the outer side of said base is attached to the display object by a magnetic member.

19. The device of claim 14, wherein the outer side of said base is attached to the display object by a fastener.

20. The device of claim 14, wherein said rear wall is curved.

21. The device of claim 14, wherein said second wall is curved.

22. The device of claim 14, wherein said channel is formed from a plastic material.

23. The device of claim 14, wherein said outer opening has a smaller width than the thickness of a weight for securing a balloon to a tether.

24. The device of claim 14, said channel comprising means for flexibly connecting said channel to another channel.

25. The device of claim 24, said means for flexibly connecting comprising a hinge.

26. A device for displaying lighter-than-air novelty balloons comprising:

a balloon weight for securing a balloon to a tether;

means for releasably supporting the balloon weight; and means for attaching said means for supporting to a display object.

27. The device of claim 26, wherein said means for attaching comprises an adhesive.

28. The device of claim 26, wherein said means for attaching comprises a magnetic member.

29. The device of claim 26, wherein said means for attaching comprises a fastener.

30. The device of claim 26, wherein said means for releasably supporting formed from a plastic material.

31. The device of claim 30, wherein said plastic means for releasably supporting comprises an elongated channel-shaped member having an elongated base with two longitudinal side walls connected thereto, the outer longitudinal edge portion of said two side walls defining a gap having a width that is smaller than the thickness of the balloon weight.

32. A display rack for displaying lighter-than-air novelty balloons comprising in combination:

a plurality of display devices, each display device comprising:

an elongated base having an outer side adapted for attachment to a display object;

a rear wall extending from said base in a direction away from the display object;

a front wall extending from said base in a direction away from the display object;

at least one of front and rear walls being flexible relative to the other; and wherein, said base, said rear wall and said front wall define a channel sized for resiliently receiving and retaining at least one weight for securing a balloon to a tether; and a pole adapted to attaching said plurality of display devices thereto.

33. The display rack of claim 33, further comprising a support stand adapted to support and maintain said pole in a vertical orientation.

34. The display rack of claim 33, wherein said channel comprises an outer opening defined by a gap between an upper edge portion of said rear wall and an upper edge portion of said second wall, the outer opening having a smaller width than the width of said base.

35. The display rack of claim 32, wherein said second wall further comprises an outwardly extending tip portion.

36. The display rack of claim 32, wherein said first wall and said second wall each comprise an outwardly extending tip portion.

37. The display rack of claim 32, wherein the outer side of said base is attached to the display object by an adhesive.

38. The display rack of claim 32, wherein the outer side of said base is attached to the display object by a magnetic member.

39. The display rack of claim 32, wherein the outer side of said base is attached to the display object by a fastener.

40. The display rack of claim 32, wherein said rear wall is curved.

41. The display rack of claim 32, wherein said front wall is curved.

42. The display rack of claim 32, wherein said channel is formed from a plastic material.

43. The display rack of claim 32, said channel comprising means for flexibly connecting said channel to another channel.

44. The display rack of claim 43, said means for flexibly connecting comprising a hinge.

45. The display rack of claim 34, wherein said outer opening has a smaller width than the thickness of a weight for securing a balloon to a tether.

46. The display rack of claim 34, and a balloon weight releasably retained within said outer opening.

47. A display rack for displaying lighter-than-air novelty balloons comprising in combination:

a plurality of display devices, each display device comprising:

an elongated base having an outer side adapted for attachment to a display object;

a rear wall extending from said base in a direction away from the display object;

a front wall extending from said base in a direction away from the display object;

at least one of front and rear walls being flexible relative to the other; and wherein, said base, said rear wall and said front wall define a channel sized for resiliently receiving and retaining at least one weight for securing a balloon to a tether; and a flat surface for attachment of said plurality of display devices thereto, wherein said flat surface defines a space for displaying a sign; and means for attaching said plurality of display devices to at least one edge of said flat surface.

48. The display rack of claim 47, wherein said channel comprises an outer opening defined by a gap between an upper edge portion of said rear wall and an upper edge portion of said second wall, the outer opening having a smaller width than the width of said base.

49. The display rack of claim 47, wherein said second wall further comprises an outwardly extending tip portion.

50. The display rack of claim 47, said first wall and said second wall each comprise an outwardly extending tip portion.

51. The display rack of claim 47, wherein the outer side of said base is attached to the display object by an adhesive.

52. The display rack of claim 47, wherein the outer side of said base is attached to the display object by a magnetic member.

53. The display rack of claim 47, the outer side of said base is attached to the display object by a fastener.

54. The display rack of claim 47, wherein said rear wall is curved.

55. The display rack of claim 47, wherein said front wall is curved.

56. The display rack of claim 47, wherein said channel is formed from a plastic material.

57. The display rack of claim 47, said channel comprising means for flexibly connecting said channel to another channel.

58. The display rack of claim 57, said means for flexibly connecting comprising a hinge.

59. The display rack of claim 48, wherein said outer opening has a smaller width than the thickness of a weight for securing a balloon to a tether.

60. The display rack of claim 48, and a balloon weight releasably retained within said outer opening.

* * * * *

UNITED STATES PATENT AND TRADEMARK OFFICE

CERTIFICATE OF CORRECTION

PATENT NO. : 6,631,811 B2
DATED : October 14, 2003
INVENTOR(S) : Samuel B. Komar and Steven B. Frank It is certified that error appears in the above-identified patent and that said Letters Patent is hereby corrected as shown below:

Column 10,
Line 24, replace “supporting formed” with -- supporting is formed --

Column 12,
Line 10, replace “claim 47, said first wall” with -- claim 47, wherein said first wall --

Signed and Sealed this

Thirtieth Day of March, 2004

JON W. DUDAS
*Acting Director of the United States Patent and Trademark Office*